United States Patent [19]

Wynnyckyj et al.

[11] Patent Number: 4,514,096

[45] Date of Patent: Apr. 30, 1985

[54] FURNACE WALL ASH DEPOSIT FLUENT PHASE CHANGE MONITORING SYSTEM

[75] Inventors: John R. Wynnyckyj, Kitchener; Edward Rhodes, Waterloo; Allan K. Chambers, Edmonton, all of Canada

[73] Assignee: University of Waterloo, Waterloo, Canada

[21] Appl. No.: 529,094

[22] Filed: Sep. 2, 1983

Related U.S. Application Data

[62] Division of Ser. No. 320,604, Nov. 12, 1981, Pat. No. 4,408,568.

[51] Int. Cl.[3] ..... G01K 17/00; G01N 25/02

[52] U.S. Cl. ..... 374/27; 122/504.2; 165/104.21; 374/29

[58] Field of Search ..... 374/29, 30, 165, 135; 165/104.21, 12, 94

[56] References Cited

U.S. PATENT DOCUMENTS

| | | | |
|---|---|---|---|
| 1,294,688 | 2/1919 | Machlet | 165/104.21 |
| 2,504,588 | 4/1950 | Rinia | 165/104.21 X |
| 3,123,996 | 3/1964 | Musial | 374/29 |
| 3,131,304 | 4/1964 | Hager, Jr. | 374/29 X |
| 3,138,025 | 6/1964 | Fingerson | 374/29 X |
| 3,566,676 | 3/1971 | Hays | 374/30 X |
| 3,720,103 | 3/1973 | Adams et al. | 374/29 |

FOREIGN PATENT DOCUMENTS

| | | | |
|---|---|---|---|
| 0198731 | 8/1967 | U.S.S.R. | 374/30 |
| 0679823 | 12/1977 | U.S.S.R. | 374/29 |

OTHER PUBLICATIONS

"Measurement of Convective and Radiative Heat Fluxes . . . of Material", Wool et al., (Aerotherm Corp.), ISA Transactions, vol. 9, No. 2, pp. 94–103.

*Primary Examiner*—Daniel M. Yasich

*Attorney, Agent, or Firm*—Sim & McBurney

[57] ABSTRACT

The build up of ash in a pulverized coal-fired boiler is achieved by comparing the heat flux simultaneously detected by a first flux detector which is maintained free of deposits and a second flux detector on which deposits are permitted to form. The net values from the heat flux comparison is proportional to the heat flux which is not reaching the boiler walls as a result of the ash deposits.

2 Claims, 5 Drawing Figures

FURNACE WALL ASH DEPOSIT FLUENT PHASE CHANGE MONITORING SYSTEM

This application is a division of application Ser. No. 320,604 filed Nov. 12, 1981 now U.S. Pat. No. 4,408,568.

Field of Invention

The present invention relates to pulverized coal fired boilers and steam generators used in power production.

BACKGROUND OF THE INVENTION

In the operation of a pulverized coal-fired boiler a significant fraction of the ash contained in the coal is deposited on the water walls of the combustion chamber and on the tubes of the convection section of the boiler. The ash deposits have a low thermal conductivity, modify the radiative properties of the surfaces and insulate the tubes from the flame. Both of these effects interfere with the efficient flame and gas-to-tube heat flux transfer.

Uncontrolled accumulation of ash often assumes catastrophic proportions necessitating boiler shutdowns. Often physical damage results to tubes in the furnace hopper when large masses of ash detach and fall there.

As a result of the generally decreased heat fluxes, a larger heat transfer surface is required than otherwise would be the case. The increased use of fouling-type coals has led to a substantial increase in furnace size for a particular load, leading to an increased initial capital cost.

Boiler operation is controlled by maintaining superheat steam temperature and flow rate by use of the available operating variables, such as, gas recirculation, burner tilt, gas tempering and steam atemperation. A need for frequent use of these adjustments is indicative of uneconomic operation.

The build up of ash on the furnace walls is controlled by the intermittent operation of soot blowers, which remove the built-up ash from the walls. At the present time the boiler operator is not provided with any direct measurement of the degree of fouling of the combustion chamber and convection section.

The degree of fouling, in general, however, is random and unpredictable with respect to its distribution on the various parts of the furnace walls, and also as to its severity at any one point. In the mode of operation, as practised according to the presently available state of the art, soot blower actuation is based on operator judgment of the indirect evidence from superheated steam and economizer temperature, burner position, and/or amount of gas recirculation and steam atemperation.

Because the boiler response time (i.e., the time where changes in degree of fouling are reflected in these variables) is long, control is erratic. Moreover, in order to avoid catastrophic loss of control, boilers are designed with larger furnaces than they otherwise might need to be. If methods and instrumentation were provided to directly monitor the degree and distribution of fouling, both the boiler control would be improved, and smaller and therefore less costly furnaces would prove adequate. As far as the applicants are aware, there has been no development to date of ash deposit-measuring instrumentation to provide such means.

SUMMARY OF INVENTION

In accordance with the present invention of the parent application, there is provided a furnace wall ash monitoring system which utilizes flux meters, or similar flux detectors. One flux meter, which is of unique construction and directly views the furnace flame, is always maintained free of any deposits, and hence receives the full heat flux from the flame. Such flux meter forms the subject of this invention. The full heat flux is also equivalent to the flux to be received by a perfectly clean water wall. Another flux meter is permitted to become fouled by ash deposits in identical manner to the water walls themselves, so that heat flux which is received by the fouled flux meter is equivalent to that received by the fouled wall.

The fluxes, detected simultaneously by each of the two meters, are converted to electrical signals indicating the detected flux values. The electrical signals are either continuously displayed by separate traces on a chart plotted by an electronic recorder, or combined electrically by special electronic circuitry and displayed by a recorder as a signal proportional to the degree of fouling of the furnace wall. Either or both of these signals can be used by the operator in boiler control. In practice, several fouled meters may be combined with a single clean meter to indicate the degree of fouling of a larger furnace wall area. Still further, several sets of clean-and-fouled-meter combinations may be judiciously distributed over all the furnace walls at various levels so as to obtain separate but continuous indications of the degree of fouling in these areas.

These signals, which indicate the degree of furnace fouling, may then be used by the operator as a basis of soot blower actuation. More importantly, he may more judiciously actuate other suitable boiler controls. Furthermore, the totality, or groups, of these signals may be recorded and manipulated by on-line use of digital computers (both macro and micro) in order to assist the automatic control of the whole boiler.

DESCRIPTION OF PREFERRED EMBODIMENTS

Figure 1:
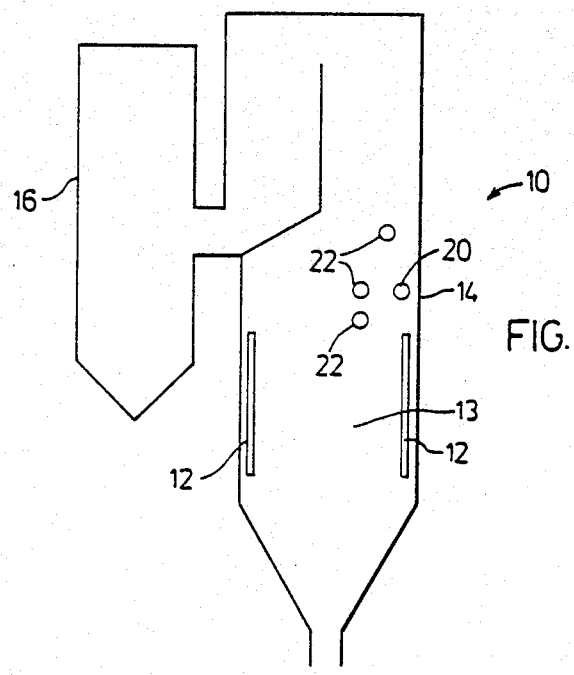
FIG. 1 is a schematic representation of one typical embodiment of a pulverized coal-fired furnace to which the present invention is applied.

Referring to the drawings, a schematic representation of one particular example of a pulverized coal-fired furnace 10 is shown in FIG. 1. Pulverized coal and air are fed through burners 12 into the interior 13 of the furnace 10. As is well known, the furnace walls 14 are comprised of a plurality of parallel tubes wherein steam is generated for feed to a steam collection system (not shown).

Combustion gases pass up into a chamber 16, known as the boiler convection section, wherein may be located superheating surfaces for the generated steam, etc. The combustion gases then may pass over an economizer and air heater before exhausting to atmosphere through a stack.

During operation of the furnace 10, ash and slag form on the furnace walls 14 sticking to the tubes, decreasing heat absorption in the furnace and otherwise causing operating difficulties. Furnace wall soot blowers (not shown) are located throughout the furnace walls and each soot blower is operative to clean a section of the furnace wall.

In accordance with the present invention, a plurality of flux meters are located in the walls 14 of the furnace 10 directly facing the flame. In the illustrated embodiment, a single flux meter 20 is maintained clean at all times while three flux meters 22 are permitted to become fouled by ash and slag during furnace operation. As stated above, any desired number of flux meters 20 and 22, or other flux detectors, may be used to achieve the desired monitoring.

Figure 2:
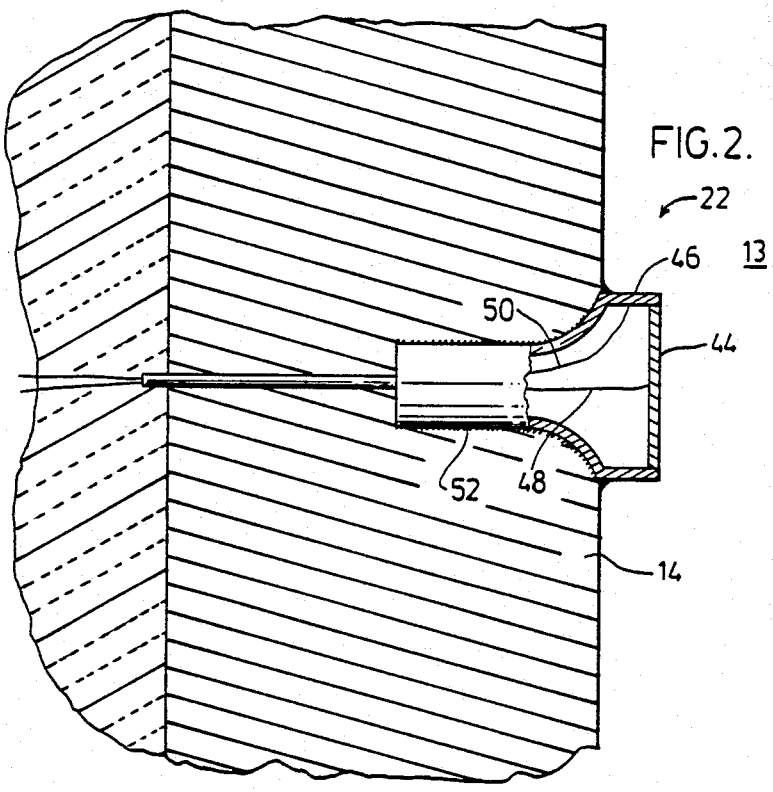
FIG. 2 is a sectional view of a flux meter which is permitted to become fouled by ash deposits in this invention.

The heat flux meters 22 are illustrated in FIG. 2 and include a meter disc sensor 44 and a meter sensor body 46 constructed of dissimilar metals and to which wire leads 48 and 50 are respectively connected. Heat flowing to the surface of the disc 44 is conducted radially to the meter body 46 and thence through an attachment mold 52 to the boiler tubes. The thermal resistance of the disc 44 causes a temperature difference between the centre of the disc and its periphery. The dissimilar metal e.m.f. generated by the flux meter is proportional to the magnitude of the disc radial temperature difference and hence to the heat flux to the meter.

Figure 3:
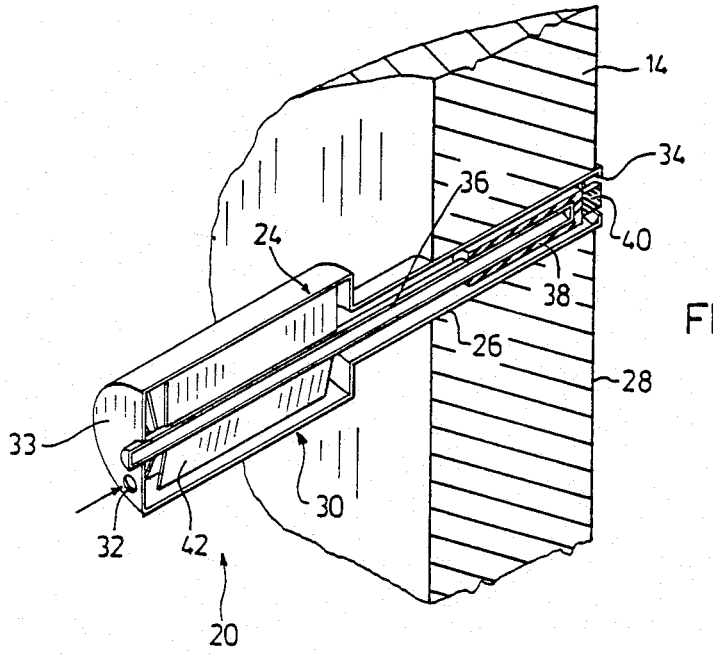
FIG. 3 is a perspective view of a flux meter which is intended to be maintained free of ash deposits in this invention.

The specific construction of the flux meter 20 is shown in the perspective view of FIG. 3. The flux meter 20 includes a housing 24 which has a smaller diameter portion 26 extending through the furnace wall 14 and terminating at the internal surface 28 of the wall 14 and an integral larger diameter portion 30 located outside the furnace wall 14.

The housing 24 has an opening 32 in the end plate 33 of the larger diameter portions 30 for feeding air into the housing 24 and openings 34 in the end of the smaller diameter portion 26 to permit air to pass therethrough into the furnace interior 13.

Located in the interior of the housing 24 is an evacuated elongate tube 36 filled to about 5% of its volume with a fluid, such as water. At one end of the tube 36, remote from the end plate 33, an external copper sleeve 38 is provided, acting as a heat sink. A flux meter 40, of any convenient type, such as, that described above with respect to FIG. 2, is mounted on the forward end of the copper sleeve 38. The lead wires to the flux meter 40 have been omitted for convenience of illustration.

The opposite end of the elongate tube 36 is provided with a plurality of heat dissipating fins 42 located in the larger diameter housing portion 30. The illustrated structure of the probe 20 enables the flux meter 40 to be maintained at a relatively constant temperature near the temperature of the wall tubes while the air envelope emerging from the opening 34 prevents build up of ash fouling on the flux meter 40.

The copper sleeve 38 acts as a heat sink which removes heat from the flux meter 40. This heat causes water present in the evacuated tube 36 to evaporate thereby cooling the copper sleeve 38. The heat exchange fins 42, which are cooled by flowing air over them through the opening 32, cause the fluid steam to recondense, thereby removing heat from the system. Meanwhile, the air flowing through the housing, from the inlet 32 to the output 34, passes over the surface of the flux meter 40 and prevents the build up of ash on that surface.

When both the flux meter 20 and the flux meter 22 are clean, on start up or after a soot removal operation, the net voltage generated by the suitably attenuated combination is zero. As the flux meter 22 becomes fouled while the flux meter 20 remains clean, the difference in voltage is a measure of the extent of the fouling of the flux meter 22. The electrical signals produced by the flux meters 20 and 22 may be recorded and continuously displayed as by separate traces on a chart plotted by an electronic recorder. Alternatively, the signals may be combined and displayed as a signal proportional to the degree of fouling of the furnace wall.

Figure 4:
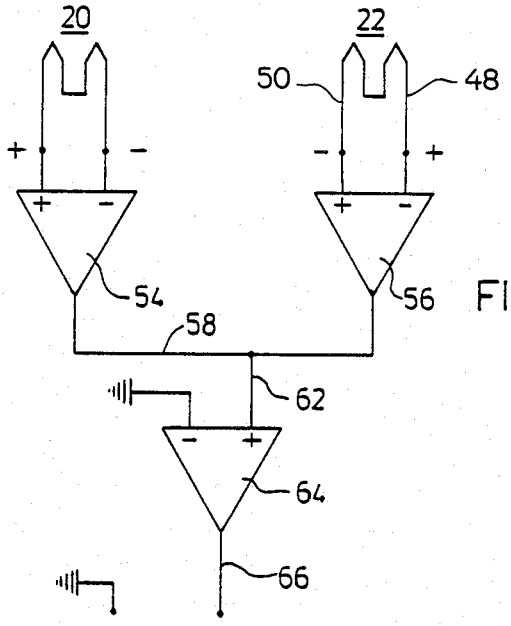
FIG. 4 is a schematic view of a typical electrical circuit used in this invention.

An electrical circuit suitable for monitoring the voltage difference is illustrated in FIG. 4. Input amplifiers 54 and 56 respectively receive the voltages produced by the flux meters 20 and 22 as a result of the detected heat fluxes. The positive and negative terminals of the flux meter 20 are connected to the positive and negative inputs respectively of the amplifier 54 to generate a positive output signal in wire 58 while the positive and negative terminals of the flux meter 22 are connected to the negative and positive inputs of the amplifier 56 to generate a negative output signal in wire 60. The wires 58 and 60 join to form an input to the positive terminal of an output gain amplifier 64, thereby generating an output signal in wire 66. The output may be recorded and displayed on a suitable recorder (not shown).

When the flux meters 20 and 22 are both clean, the amplifiers 54 and 56 are adjusted to provide a zero voltage output in wire 66, the positive potential in wire 58 balancing the negative potential in wire 60. As fouling of flux meter 22 occurs, the negative potential in wire 60 decreases and the potential in wire 62 becomes more positive, thereby producing a positive potential in wire 66 which is proportional to the decrease in heat flux through the furnace water walls due to fouling of the flux meter 22.

In the above description, the flux meter which is maintained clean at all times is essentially of the same design as the one allowed to be fouled, except that flux meter 40 is mounted in a special manner, as seen in FIG. 3. In another embodiment of this invention, in place of heat flux meter 40, mounted as shown in FIG. 3, a recording radiation pyrometer, sensitive in the infra-red region of the electromagnetic spectrum, and/or a total radiation pyrometer, can be used. Both the latter instruments are commercially available and are known to those familiar with temperature measurement. They have not yet been put to use in such an application as the present.

In this invention, therefore, heat flux sensors or detectors, preferably in the form of flux meters, but also including pyrometers and/or thermocouples, are directly exposed to the heat flux within the furnace. Two different types of detectors are used, one of which is maintained free from contamination at all times and the other of which is allowed to become contaminated in the furnace. The voltages generated by the detectors are simultaneously measured and compared to provide an instantaneous indication of the heat flux loss due to fouling of the probe 22 and hence fouling of the furnace walls in the location of the probe 22.

The signal indicative of the degree of furnace fouling may be used by a furnace operator as a determination for initiation of soot blower operation and/or other furnace control action known in the art. Alternatively, the signal may be utilized for automatic initiation of soot blower operation or automatic control of the whole boiler.

EXAMPLE

A coal fired boiler of the type shown in FIG. 1 was operated for a two month period with probes 20 and 22 located therein. The boiler was a 150 MW Combustion Engineering Superheater corner-fired pulverized coal boiler, operated at 1800 psi and a superheat steam temperature of 1000° F. (585° C.).

The value of the combined signal in wire 66 was monitored as heat flux loss and the actual heat flux values detected by the probes 20 and 22 were also monitored separately. The results were recorded graphically and the results for a typical six hour run are shown in FIG. 5.

Figure 5:
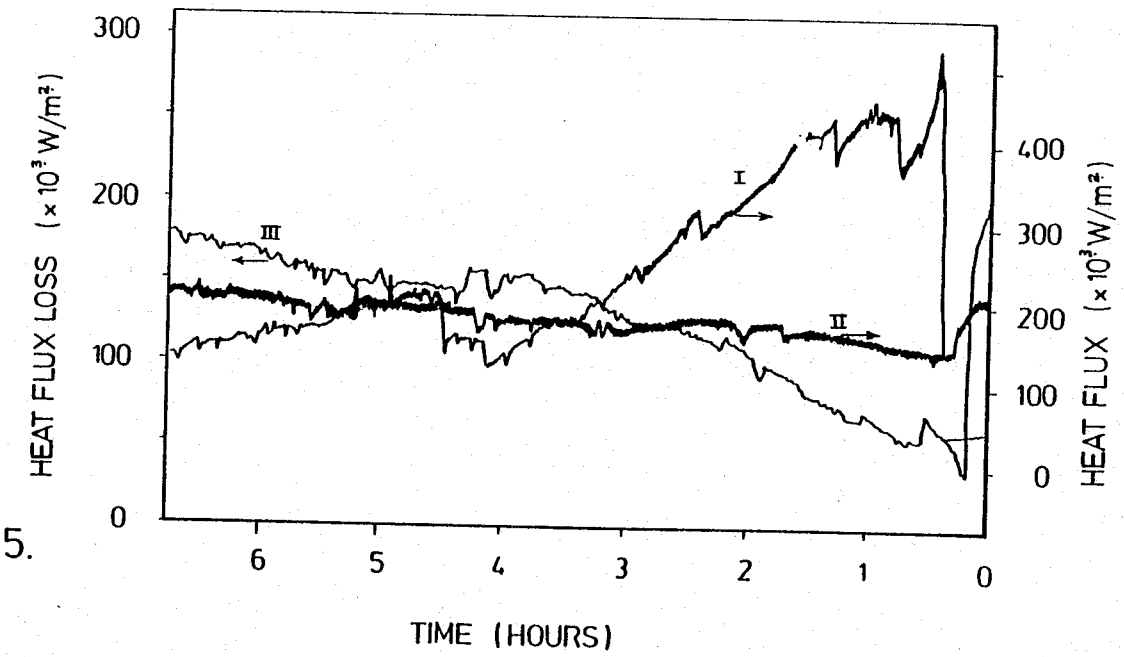
FIG. 5 is a graphical representation of typical experimental results obtained using the present invention.

As may be seen from FIG. 5, the combined output signal (curve III) expressed as heat flux loss, was near zero immediately after a soot blow (shown at the right of FIG. 5). The heat flux loss slowly increased as the ash deposit built up. The heat flux measured by the clean probe (curve II) increased slowly as the fouling of the furnace walls decreased the total rate of heat transfer from the flame to the water walls, causing the temperature of the latter to increase. The flux measured by the fouled probe (curve I) fall rapidly initially, went through a vacillation phase due to ash deposit consolidation, and then fell less rapidly.

SUMMARY OF DISCLOSURE

In summary of this disclosure, the present invention provides a novel and accurate pulverized coal-fired boiler furnace monitoring system which utilizes the simultaneous measurement of heat flux within the furnace by two probes. Modifications are possible within the scope of this invention.

What we claim is:

1. A heat flux measuring device, comprising:

an enclosed elongate housing having air flow paths extending therethrough from an air inlet adjacent one end of said enclosure to an air outlet adjacent the other end of said enclosure, heat flux sensing means located adjacent said air outlet to permit air flowing through said enclosure to flow over said heat flux sensing means and prevent the build-up of ash thereon, elongated evacuated tube means containing water and extending generally axially within said housing from adjacent said one end of said enclosure towards said other end of said enclosure, heat sink means in heat conducting relationship with an end of said evacuated tube adjacent said other end of said enclosure, said heat flux sensing means being mounted to and in heat conducting relationship with said heat sink means, and heat exchange means within said enclosure in heat conducting relationship with the other end of said evacuated tube, whereby, upon said flux sensing means being heated by heat flux, and heat sink means conducts said heat flux to said tube means to evaporate said water in said tube while said heat exchange means cools said tube and condenses the steam formed by said water evaporation, so that heat is removed from said flux detection means.

2. The heat flux meter of claim 1 wherein said heat sink means comprises a copper sheath surrounding said tube means and said heat exchange means comprises a plurality of heat exchange fins extending radially of said tube means.

* * * * *